US008777389B2

(12) United States Patent
Katoh

(10) Patent No.: US 8,777,389 B2
(45) Date of Patent: Jul. 15, 2014

(54) IMAGE FORMING APPARATUS INCLUDING RECORDING HEAD FOR EJECTING LIQUID DROPLETS

(75) Inventor: Tomomi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/417,413

(22) Filed: Mar. 12, 2012

(65) Prior Publication Data

US 2012/0236094 A1 Sep. 20, 2012

(30) Foreign Application Priority Data

Mar. 16, 2011 (JP) ..... 2011-058139

(51) Int. Cl.
*B41J 2/19* (2006.01)

(52) U.S. Cl.
USPC ..... 347/93; 347/92; 347/87; 347/86; 347/84

(58) Field of Classification Search
USPC ..... 347/92, 93, 85–87
See application file for complete search history.

(56) References Cited

U.S. PATENT DOCUMENTS

| | | | | |
|---|---|---|---|---|
| 7,325,908 | B2 * | 2/2008 | Katoh | 347/85 |
| 7,438,397 | B2 * | 10/2008 | Anderson, Jr. et al. | 347/84 |
| 7,571,997 | B2 * | 8/2009 | Nakamura | 347/92 |
| 7,905,585 | B2 * | 3/2011 | Tanaka et al. | 347/85 |
| 8,356,888 | B2 * | 1/2013 | Takata | 347/84 |
| 2003/0206221 | A1 * | 11/2003 | Hoen et al. | 347/92 |
| 2008/0049084 | A1 * | 2/2008 | Katada | 347/92 |
| 2009/0290002 | A1 | 11/2009 | Katoh | |
| 2009/0315959 | A1 * | 12/2009 | Fukazawa et al. | 347/85 |
| 2010/0123765 | A1 * | 5/2010 | Takata | 347/92 |
| 2010/0214378 | A1 | 8/2010 | Katoh et al. | |
| 2010/0245498 | A1 * | 9/2010 | Koizumi et al. | 347/85 |
| 2010/0277555 | A1 * | 11/2010 | Katoh et al. | 347/86 |
| 2011/0050816 | A1 | 3/2011 | Katoh et al. | |
| 2011/0134184 | A1 | 6/2011 | Katoh et al. | |
| 2011/0141167 | A1 | 6/2011 | Kikkawa et al. | |
| 2011/0164078 | A1 | 7/2011 | Katoh et al. | |
| 2011/0216111 | A1 | 9/2011 | Katoh | |
| 2012/0044284 | A1 | 2/2012 | Katoh | |

FOREIGN PATENT DOCUMENTS

| | | |
|---|---|---|
| JP | 2010-58294 | 3/2010 |
| JP | 2010-120263 | 6/2010 |

* cited by examiner

*Primary Examiner* — Matthew Luu
*Assistant Examiner* — Lily Kemathe
(74) *Attorney, Agent, or Firm* — Cooper & Dunham LLP

(57) ABSTRACT

An image forming apparatus includes a recording head, a head tank, an exhaust unit, and a suctioning device. The head tank has liquid chambers with exhaust ports. The exhaust unit includes an exhaust channel connected to the suctioning device to exhaust air from the head tank, an exhaust chamber connected to the ports of the liquid chambers, a valve member to collectively open and close the ports, a valve driving chamber communicating with the exhaust channel and having a flexible member forming a wall face thereof, a valve driving member disposed at the flexible member to open and close the valve member, and a choke channel communicating the exhaust chamber with the valve driving chamber. When the suctioning device suctions air through the exhaust channel with the liquid being in the choke channel, a volume of the valve driving chamber contracts and the valve member opens the ports.

8 Claims, 8 Drawing Sheets

IMAGE FORMING APPARATUS INCLUDING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application No. 2011-058139, filed on Mar. 16, 2011, in the Japan Patent Office, the entire disclosure of which is hereby incorporated by reference herein.

BACKGROUND

1. Technical Field

This disclosure relates to an image forming apparatus, and more specifically to an image forming apparatus including a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink. Such inkjet-type image forming apparatuses fall into two main types: a serial-type image forming apparatus that forms an image by ejecting droplets from the recording head while moving a carriage mounting the recording head in a main scanning direction, and a line-head-type image forming apparatus that forms an image by ejecting droplets from a linear-shaped recording head held stationary in the image forming apparatus.

As for the recording heads used in these liquid-ejection-type image forming apparatuses, several different types are known. One example is a piezoelectric recording head that ejects droplets by deforming a diaphragm using, e.g., piezoelectric actuators. When the piezoelectric actuators deform the diaphragm, the volumes of chambers containing the liquid change. As a result, the internal pressures of the chambers increase, thus ejecting droplets from the head. Another example is a thermal recording head that ejects droplets by increasing the internal pressures of chambers using, e.g., heaters disposed in the chambers. The heaters are heated by electric current to generate bubbles in the chambers. As a result, the internal pressures of the chambers increase, thus ejecting droplets from the head.

For such liquid-ejection type image forming apparatuses, there is demand for enhancing throughput, i.e., speed of image formation. One way to increase the throughput is to enhance the efficiency of liquid supply. For example, a tube supply method is proposed in which ink is supplied from a large-volume ink cartridge (main tank) mounted in the image forming apparatus to a head tank (also referred to as a sub tank or buffer tank) mounted in an upper portion of the recording head through a tube.

In this regard, in a case where ink is supplied from the ink cartridge to the head tank via a tube made of, e.g., resin, it is difficult to use the head tank with the head tank constantly full of ink and an air layer is formed in an upper space of the head tank. The amount of air in the head tank is likely to increase over time due to air permeating from wall faces of the resin tube and the head tank or air bubbles entering the tube at the installation and removal of the ink cartridge.

A small amount of air in the head tank is not so problematic. However, if the amount of air in the head tank is too large, the amount of change in the volume of air relative to temperature change increases. As a result, the internal pressure of the head tank may be out of a proper range of negative pressures to be maintained, thus leaking ink from nozzles of the recording head or hampering normal ink ejection. In addition, when the amount of air in the head tank is too large, air may mix into ink, thus hampering normal droplet ejection.

Therefore, it is preferable to control the amount of air in the head tank below a threshold amount while maintaining the internal pressure of the head tank within a proper range.

Hence, for example, JP-2010-120263-A proposes a liquid ejection apparatus that has an exhaust mechanism including an air storage part, a valve, and a flexible member. The air storage part is disposed at a liquid supply channel for supplying liquid to the recording head and temporarily stores air contained in ink. The valve opens and closes an exhaust passage leading from the air storage part to the outside. The flexible member is deformed by negative pressure generated in the exhaust passage to open the valve and exhaust air from the air storage part to the outside through the exhaust passage.

However, in the above-described configuration, by negative pressure (exhaust pressure) generated in the exhaust passage, the flexible member is deformed to open the valve. As a result, when the valve is opened, the exhaust pressure may affect the internal pressure of the head, thus sucking air from the nozzles into the liquid ejection head.

In other words, a large negative pressure need be applied to the exhaust passage to open the valve, and once the valve is opened, the large negative pressure directly acts on the liquid ejection head. In particular, in a case where air is exhausted from a plurality of air storage parts, a larger negative pressure need be applied to the exhaust passage, thus making it difficult to perform exhaust operation with the pressure of the head stably maintained.

BRIEF SUMMARY

In an aspect of this disclosure, there is provided an image forming apparatus including a recording head, a head tank, an exhaust unit, and a suctioning device. The recording head has nozzles to eject droplets of liquid. The head tank has a plurality of liquid chambers to supply the liquid to the recording head. The plurality of liquid chambers has exhaust ports to exhaust air therefrom. The exhaust unit is connected to the head tank to exhaust air from the head tank. The suctioning device is connected to the exhaust unit. The exhaust unit includes an exhaust channel, an exhaust chamber, a valve member, a valve driving chamber, a valve driving member, and a choke channel. The exhaust channel is connected to the suctioning device to exhaust air from the head tank. The exhaust chamber is connected to the exhaust ports of the plurality of liquid chambers. The valve member collectively opens and closes the exhaust ports. The valve driving chamber communicates with the exhaust channel and has a flexible member forming a wall face of the valve driving chamber. The valve driving member is disposed at the flexible member to open and close the valve member. The choke channel communicates the exhaust chamber with the valve driving chamber. When the suctioning device suctions air through the exhaust channel with the liquid being in the choke channel, a volume of the valve driving chamber contracts and the valve member opens the exhaust ports.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
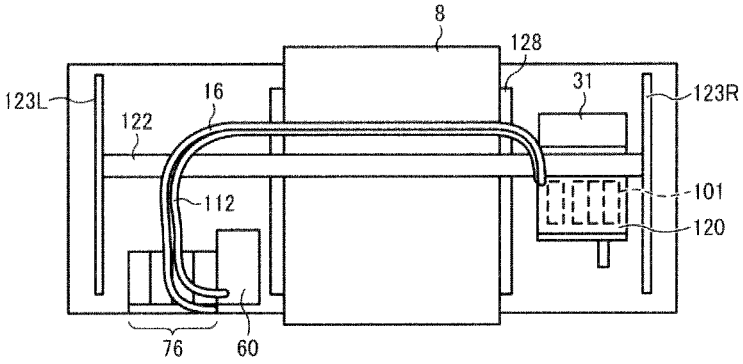
FIG. 1 is a schematic plan view of an inkjet recording apparatus as an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium (in other words, the term "image formation" includes only causing liquid droplets to land on the medium). The term "ink" as used herein is not limited to "ink" in a narrow sense and includes any types of liquid useable for image formation, such as a recording liquid, a fixing solution, a DNA sample, and a pattern material. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet. The term "image" used herein is not limited to a two-dimensional image and includes, for example, an image applied to a three dimensional object and a three dimensional object itself formed as a three-dimensionally molded image.

Referring now to the drawings, wherein like reference numerals designate identical or corresponding parts throughout the several views, exemplary embodiments of the present disclosure are described below.

Figure 2:
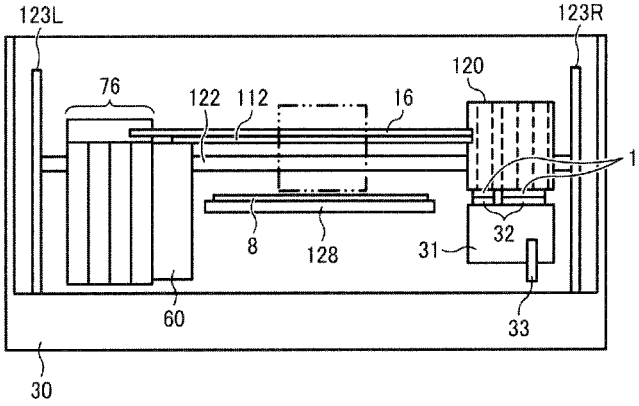
FIG. 2 is a schematic front view of the inkjet recording apparatus illustrated in FIG. 1.
Figure 3:
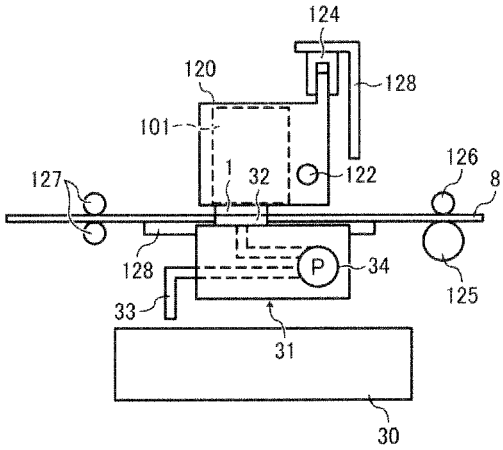
FIG. 3 is a schematic side view of the inkjet recording apparatus illustrated in FIG. 1.

First, an inkjet recording apparatus is described as an image forming apparatus according to an exemplary embodiment of this disclosure with reference to FIGS. 1 to 3.

FIG. 1 is a schematic plan view of an inkjet recording apparatus 1000 according to an exemplary embodiment of this disclosure. FIG. 2 is a schematic front view of the inkjet recording apparatus 1000. FIG. 3 is a schematic side view of the inkjet recording apparatus 1000.

In the inkjet recording apparatus 1000, a carriage 120 is supported by a guide rod 122 and a guide rail 124 so as to slide in a main scanning direction (i.e., a long direction of the guide rod 122). The guide rod 122 serving as a guide member extends between a left side plate 123L and a right side plate 123R standing on a main frame 30, and the guide rail 124 is mounted on a rear frame 128 extending to the main frame 30. The carriage 120 is moved in the long direction of the guide rod 122 (the main scanning direction) by a main scanning motor 551 and a timing belt.

On the carriage 120 are mounted recording heads 1 (liquid ejection heads) for ejecting ink droplets of different colors, e.g., black (K), cyan (C), magenta (M), and yellow (Y). The recording heads 1 are mounted on the carriage 120 so that multiple ink-ejection ports (nozzles) are arranged in a direction perpendicular to the main scanning direction and ink droplets are ejected downward from the nozzles.

Figure 4:
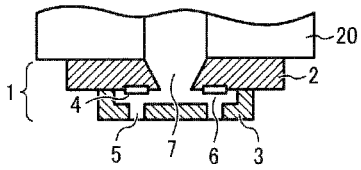
FIG. 4 is a partially enlarged view of a recording head of the inkjet recording apparatus illustrated in FIG. 1.

As illustrated in FIG. 4, each of the recording heads 1 includes a heater substrate 2 and a chamber formation member 3 and ejects, as liquid droplets, ink sequentially supplied to a common channel 7 and liquid chambers (separate channels) 6 through an ink supply passage formed in a base member 20. As illustrated in FIG. 4, the recording heads 1 may be, for example, a thermal-type head that obtains pressure for ejecting ink by film boiling of ink generated by driving heaters 4 and a side-shooter-type head in which the direction of ink flowing toward each ejection-energy acting part (heater part) within each liquid chamber 6 is perpendicular to the central axis of an opening of each nozzle 15.

It is to be noted that the recording head is not limited to the thermal type head but may be a piezoelectric-type head that obtains ejection pressure by deforming a diaphragm with piezoelectric elements, an electrostatic-type head that obtains ejection pressure by deforming a diaphragm with electrostatic force, or any other suitable type head.

Below the carriage 120, a sheet 8 on which an image is formed by the recording heads 1 is conveyed in a direction (hereinafter "sub-scanning direction") perpendicular to the main scanning direction. As illustrated in FIG. 3, the sheet 8 is sandwiched between a conveyance roller 125 and a pressing roller 126 and conveyed to an image formation area (printing area) of the recording heads 1. The sheet 8 is further conveyed onto a printing guide member 128 and fed by a pair of output rollers 127 in a sheet output direction.

At this time, the scanning of the carriage 120 in the main scanning direction is properly synchronized with the ejection of ink droplets from the recording heads 1 in accordance with image data to form a first band of a desired image on the sheet 8. After the first band has been formed, the sheet 8 is fed by a certain distance in the sub-scanning direction and the recording heads 1 form a second band of the target image on the sheet 8. By repeating such operations, the whole image is formed on the sheet 8.

To an upper part of the recording heads 1 is integrally connected a head tank (buffer tank or sub tank) 101 including ink chambers 104 that temporarily store ink. The term "integrally" as used herein represents that the recording heads 1 and the head tank 101 are mounted on the carriage 120, and also includes that the recording heads 1 are connected to the head tank 101 via, e.g., tubes or pipes.

Desired color inks are supplied from ink cartridges (main tanks) 76 serving as liquid tanks that separately store the respective color inks, to the head tank 101 via liquid supply tubes 16. The ink cartridges (main tanks) 76 are detachably mounted on, e.g., a cartridge holder disposed at one end of the inkjet recording apparatus 1000 in the main scanning direction.

A suctioning pump 60 serving as a suctioning device is connected to the head tank 101 via an exhaust tube 112.

At the other end of the inkjet recording apparatus 1 in the main scanning direction is disposed a maintenance unit 31 that maintains and recovers conditions of the recording heads 1. The maintenance unit 31 has caps 32 to cover nozzle faces of the recording heads 1 and a aspiration pump 34 to aspirate the interior of the caps 32, and a drain passage 33 through which waste liquid (waste ink) aspirated with the aspiration pump 34 is drained. The waste ink is discharged from the drain passage 33 to a waste tank mounted on the main frame 30. The maintenance unit 31 also has a moving mechanism to move the caps 32 back and forth (in this embodiment, up and down) relative to the nozzle faces of the recording heads 1. The maintenance unit 31 further has a wiping member to wipe the nozzle faces of the recording heads 1 and a wiping unit to hold the wiping member so as to be movable back and forth relative to the nozzle faces of the recording heads 1.

Next, a head tank in a first exemplary embodiment is described with reference to FIGS. 5 to 6.

Figure 5:
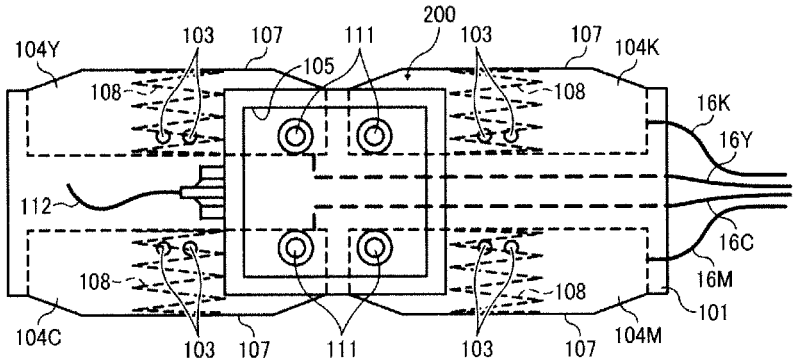
FIG. 5 is a plan view of a head tank in a first exemplary embodiment.
Figure 6:
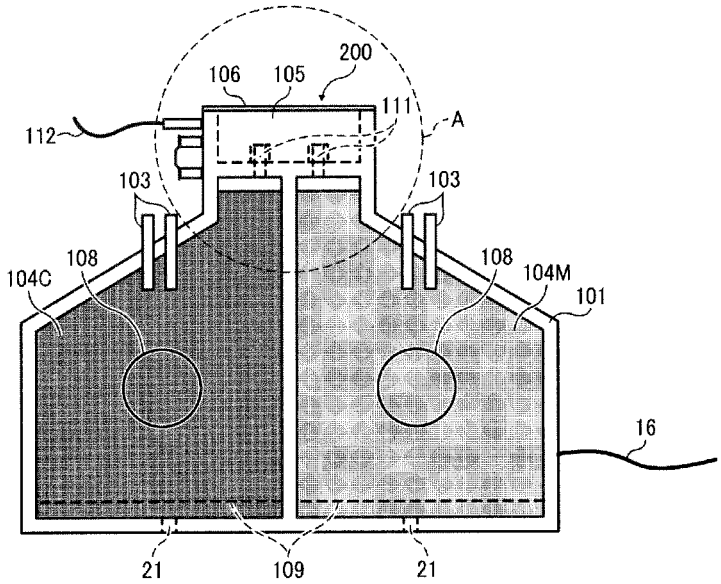
FIG. 6 is a front view of the head tank illustrated in FIG. 5.

FIG. 5 is a plan view of a head tank in the first exemplary embodiment, and FIG. 6 is a front view of the head tank. In FIGS. 5 and 6, components may be omitted or cross sections may be partially shown for clarity.

The head tank 101 has integrally-molded ink chambers 104Y, 104M, 104C, and 104K (collectively referred to as "ink chambers 104" unless colors are distinguished) serving as liquid storage chambers to store yellow (Y), magenta (M), cyan (C), and black (K) inks, respectively. The head tank 101 includes filters 109 adjacent to portions connected to the recording heads 1 to filter ink to remove foreign substances from the ink, and supplies the filtered ink to the recording heads 1 via supply ports 21.

The head tank 101 has film members 107, each of which is a flexible member molded in concave shape to form a wall face of the head tank 101. Each flexible member 107 is urged by a spring 108 in such a direction as to increase the volume of the head tank 101. The head tank 101 has an air-amount sensor 103 to detect the amount of air in the head tank 101.

The air-amount sensor 103 includes paired electrodes to detect a liquid level of ink within each ink chamber 104 based on a change in electric resistance between the electrodes. In other words, the air-amount sensor 103 serves as a liquid level detector to detect the liquid level of ink within each ink chamber 104. As described above, one end of each liquid supply tube 16 is connected to the head tank 101 and the other end is connected to a corresponding one of the ink cartridges 76. The ink cartridges 76 are disposed lower than the nozzle faces of the recording heads 1 to maintain the interiors of the recording heads 1 with in a proper range of negative pressures by liquid head difference.

At an upper portion of the head tank 101 is disposed an exhaust mechanism (exhaust unit) 200 serving as an air exhaust unit to exhaust air from the ink chambers 104 via the exhaust tube 112 serving as an exhaust channel.

Next, the exhaust unit 200 is described with reference to FIGS. 7 to 9.

Figure 7:
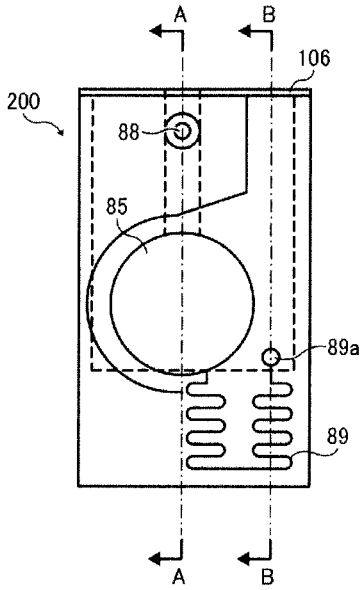
FIG. 7 is a side view of an exhaust unit of the head tank illustrated in FIG. 5.
Figure 8:
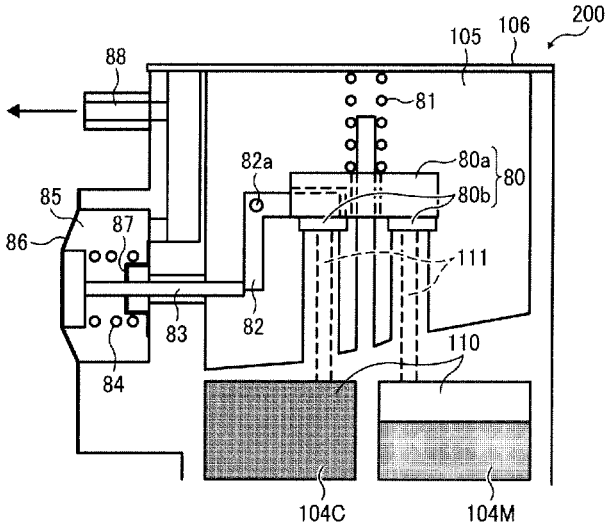
FIG. 8 is a cross-sectional view of the exhaust unit cut along a line A-A of FIG. 7.
Figure 9:
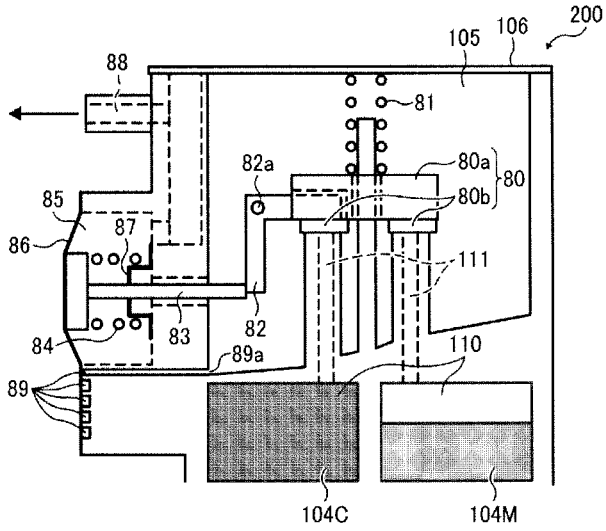
FIG. 9 is a cross-sectional view of the exhaust unit cut along a line B-B of FIG. 7.

FIGS. 7 to 9 are enlarged views of the exhaust unit 200 and its surrounding area indicated by a circle A of FIG. 6. FIG. 7 is a side view of the exhaust unit 200. FIG. 8 is a cross-sectional view of the exhaust unit 200 cut along a line A-A of FIG. 7. FIG. 9 is a cross-sectional view of the exhaust unit 200 cut along a line B-B of FIG. 7.

The exhaust unit 200 has a common exhaust chamber 105 commonly used for the ink chambers 104 and exhaust ports 111 dedicated to the ink chambers 104. Each exhaust port 111 serving as an exhaust opening is disposed at an upper portion of each ink chamber 104 and connected so as to be openable to the common exhaust chamber 105. The upper side of the common exhaust chamber 105 is covered with a cover member 106.

Within the common exhaust chamber 105 is disposed an air release valve 80 serving as a valve member to collectively open and close the exhaust ports 111 of the ink chambers 104. The air release valve 80 has a valve body 80*a* with seal members 80*b* and serves as a normally closed valve with each seal member 80*b* being pressed against an opening side of each exhaust port 111 by a first urging spring 81 serving as a first urging member. When the air release valve 80 is pushed up by an L-shaped driving lever 82 folded downward relative to the air release valve 80, the air release valve 80 opens the exhaust ports 111. The driving lever 82 is pivotably supported by a support shaft 82*a*.

The common exhaust chamber 105 communicates from a lower opening (exhaust port) 89*a* with a lower portion of a pin driving chamber 85 serving as a valve driving chamber via a choke channel 89. The choke channel 89 is a narrow tubular channel formed by sealing, with a flexible film 86, an opening of a passage formed in a wall face of the head tank 101.

A driving pin 83 and a second urging spring 84 are disposed in the pin driving chamber 85. The driving pin 83 is a valve driving member movable back and forth relative to the driving lever 82. The second urging spring 84 is a second urging member to urge the driving pin 83 away from the driving lever 82. The flexible film 86 forms a wall face of the pin driving chamber 85, and when the flexible film 86 deforms inward, the driving pin 83 moves in such a direction to push the driving lever 82.

Between the pin driving chamber 85 and the common exhaust chamber 105 is formed a thorough hole through which the driving pin 83 passes. A deformable seal member 87 seals around the thorough hole to communicate the pin driving chamber 85 with the common exhaust chamber 105 only through the choke channel 89.

The pin driving chamber 85 is connected to an exhaust channel 88, thus allowing the suctioning pump 60 to suction and exhaust air from the pin driving chamber 85 via the exhaust tube 112.

The suctioning pump 60 is preferably a gear pump, a diaphragm pump, or any other type of pump capable of opening the channel under suspension. However, even if, like a tube pump, a pump closes the channel under suspension, the pump can be employed provided that air can be released through a branched channel.

Next, exhaust operation of the exhaust unit 200 is described with reference to FIGS. 10 to 12.

Figure 10:
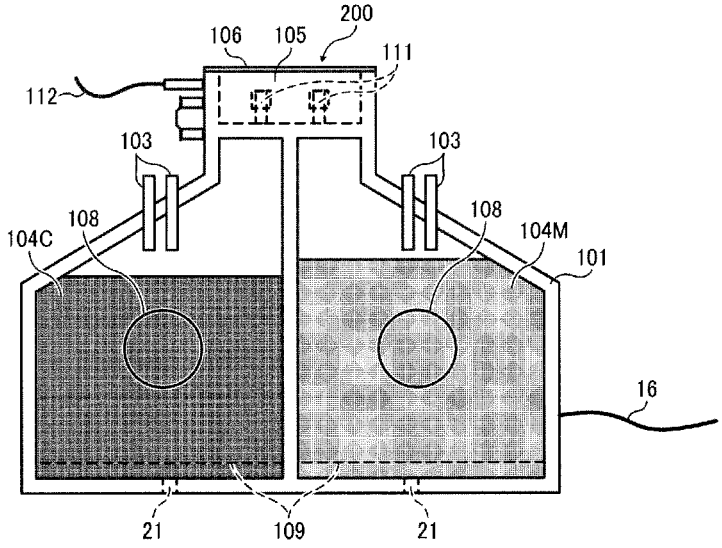
FIG. 10 is a front view of the head tank at a state in which air is accumulated in ink chambers.

FIG. 10 is a front view of the head tank 101. FIGS. 11 and 12 are cross-sectional views of different states of the exhaust unit 200 during exhaust operation.

As illustrated in FIG. 10, when air accumulates in an ink chamber 104, the liquid level in the ink chamber 104 decreases. Thus, the air-amount sensor 103 can detect that the liquid level has decreased to a threshold level or lower, that is, the amount of air accumulated in each ink chamber 104 has exceeded a threshold amount.

Figure 11:
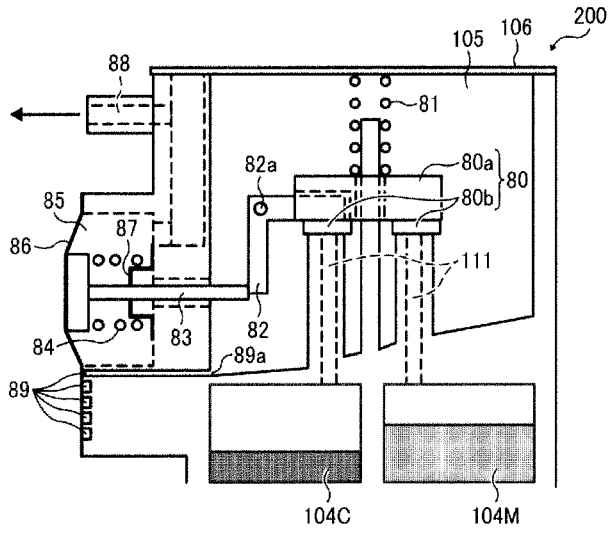
FIG. 11 is a cross-sectional view of a state of the exhaust unit during exhaust operation.

When the suctioning pump 60 starts exhaust operation, as illustrated in FIG. 11, air is exhausted from the pin driving chamber 85 with the air release valve 80 closed. As a result, the flexible film 86 is pulled inward, thus pushing the driving pin 83 inward against the urging force of the second urging spring 84. Thus, as illustrated in FIG. 12, the driving lever 82 pivots in a direction indicated by an arrow C to open the air release valve 80. When the air release valve 80 is opened, air is exhausted from the ink chambers 104 to the common exhaust chamber 105 via the exhaust ports 111.

At this time, if the flow amount of exhaust air is too large, the negative pressure in each ink chamber 104 excessively increases, thus undesirably suctioning air from the nozzles of the recording heads 1. Hence, the flow amount of exhaust air is preferably approximately 0.1 to approximately 0.2 cc/s. By contrast, if the flow amount of exhaust air is small, the negative pressure in each ink chamber 104 decreases, thus closing the air release valve 80 (FIG. 11). When the air release valve 80 is closed, the negative pressure in each ink chamber 104 increases again. As a result, the air release valve 80 is opened, thus exhausting air from each ink chamber 104. Thus, while the states illustrated in FIGS. 11 and 12 are alternately repeated, air is exhausted from each ink chamber 104.

As described above, in this exemplary embodiment, the head tank 101 has the air-amount sensor 103, thus allowing the suctioning pump 60 to be stopped based on detection results of the air-amount sensor 103.

In this exemplary embodiment, air is exhausted from each of the ink chambers 104 to the suctioning pump 60 through a single exhaust passage (including each exhaust port 111, the common exhaust chamber 105, the choke channel 89, the pin driving chamber 85, the exhaust channel 88, and the exhaust tube 112).

Figure 12:
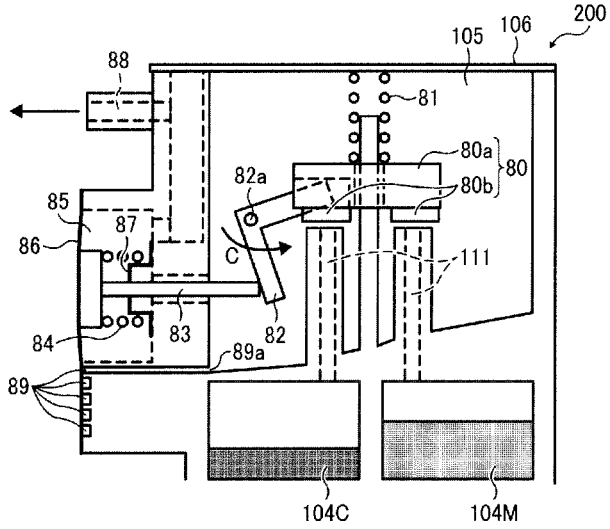
FIG. 12 is a cross-sectional view of another state of the exhaust unit during exhaust operation.

In the exhaust operation, as illustrated in FIG. 12, if the air release valve 80 is not completely opened and the valve body 80*a* only slightly moves up, the exhaust ports 111 of the ink chambers 104 might not be partially opened. In such a case, ink outflows from one ink chamber 104 having finished exhaust operation into the common exhaust chamber 105 through the corresponding exhaust port 111. The outflow ink further flows into the choke channel 89, thus rapidly increasing the negative pressure in the pin driving chamber 85. As a result, the driving pin 83 is pushed inward to a maximum amount, thus fully moving up the air release valve 80. Thus, all of the exhaust ports 111 of the ink chambers 104 are opened, thus allowing air to be reliably exhausted from all of the ink chambers 104.

Next, a second exemplary embodiment of the present disclosure is described with reference to FIG. 13.

Figure 13:
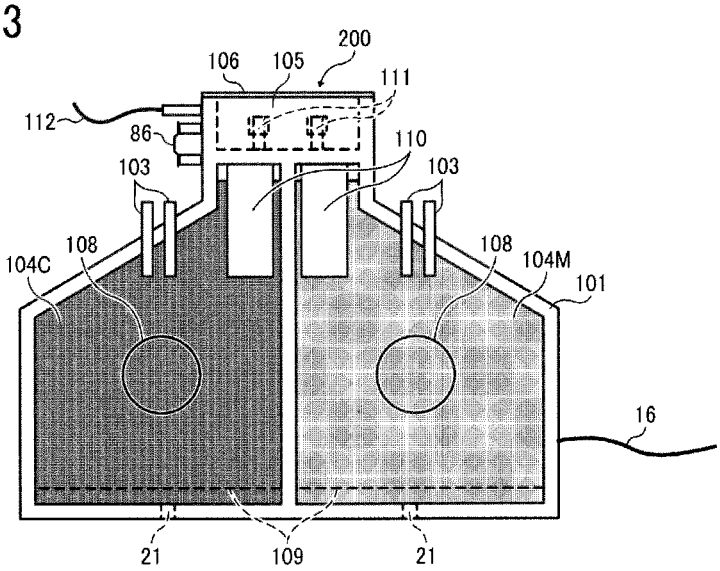
FIG. 13 is a front view of a head tank in a second exemplary embodiment.

FIG. 13 is a front view of a head tank 101 in the second exemplary embodiment.

In this exemplary embodiment, the head tank 101 has a floating valve 110 in each ink chamber 104, instead of the air-amount sensor 103 in the first exemplary embodiment.

In this configuration, as with the above-described first exemplary embodiment, when the suctioning pump 60 drives to perform exhaust operation, air is exhausted from each ink chamber 104 while the states illustrated in FIGS. 11 and 12 are alternately repeated. Then, as the liquid level of ink in an ink chamber 104 rises, the corresponding exhaust port 111 is closed with the floating valve 110, thus automatically shutting off the ink chamber 104 from the common exhaust chamber 105.

In a case where the flow amount of air exhaust is small, the exhaust ports 111 of the ink chambers 104 might not be partially opened due to the small flow amount. Even in such a case, from one ink chamber 104 having finished exhaust operation, the corresponding exhaust port 111 is closed with the floating valve 110. As a result, each time another ink chamber 104 finishes exhaust operation, the corresponding exhaust port 111 is closed with the floating valve 110, thus increasing the negative pressure in the pin driving chamber 85. Finally, all of the exhaust ports 111 of the ink chambers 104 are opened, thus allowing air to be reliably exhausted from all of the ink chambers 104.

Figure 15:
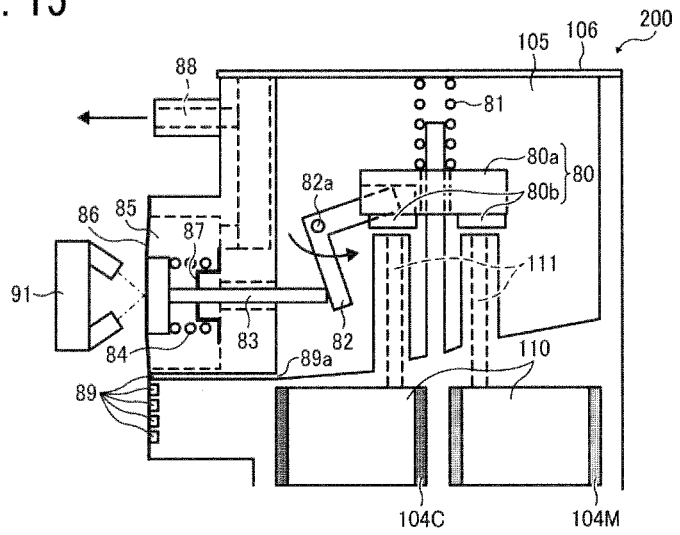
FIG. 15 is a cross-sectional view of a state of an exhaust unit during exhaust operation in the third exemplary embodiment.
Figure 16:
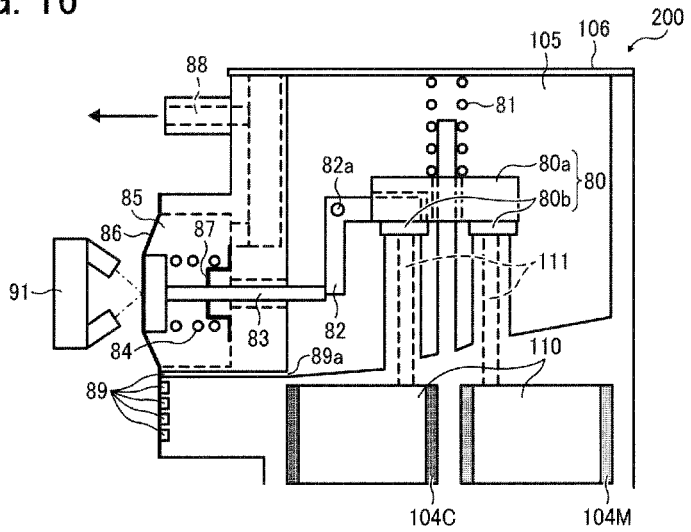
FIG. 16 is a cross-sectional view of another state of the exhaust unit during exhaust operation in the third exemplary embodiment.

Next, a third exemplary embodiment of the present disclosure is described with reference to FIGS. 14 to 16.

Figure 14:
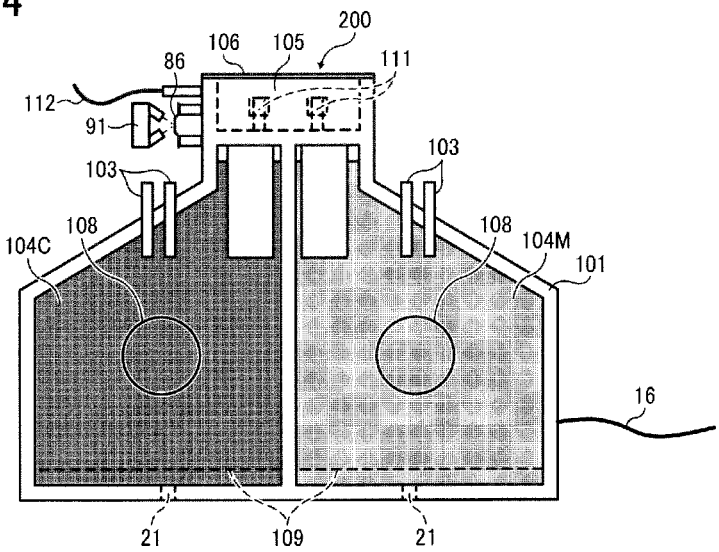
FIG. 14 is a front view of a head tank in a third exemplary embodiment.

FIG. 14 is a front view of a head tank 101 in the third exemplary embodiment. FIGS. 15 and 16 are cross-sectional views of different states of an exhaust unit 200 in exhaust operation in the third exemplary embodiment. In this exemplary embodiment, the head tank 101 has a flexible film 86 forming a wall face of the pin driving chamber 85 and a position sensor 91 serving as an optical sensor to detect the position of the driving pin 83 by sensing a displacement of the flexible film 86. In other words, the position sensor 91 serves as a volume detector to detect a change in the volume of the pin driving chamber 85 by sensing a displacement of the flexible film 86.

As described above, when air is fully exhausted from all of the ink chambers 104, the exhaust passage is choked. As a result, as illustrated in FIG. 15, the pin driving chamber 85 is fully contracted. If such a contracted state of the pin driving chamber 85 continues over a threshold time, it is determined that the exhaust operation on the ink chambers 104 has been completed, and the suctioning pump 60 is stopped.

Then, as fluid (air and ink) flows back from the suctioning pump 60, the volume of the pin driving chamber 85 restores. As a result, the pushing force of the driving pin 83 against the driving lever 82 decreases, thus closing the air release valve 80.

Accordingly, by detecting the position of the driving pin 83 with the position sensor 91, closing of the air release valve 80 can be confirmed, thus allows smooth shift to a subsequent operation, such as printing operation, without an extra waiting time.

In this exemplary embodiment, the second urging spring 84 is disposed in the pin driving chamber 85 to urge the driving pin 83 in such a direction as to increase the volume of the head tank 101. Thus, when the suctioning pump 60 stops, the driving pin 83 can immediately and reliably return to the original position.

In the above description, the operation and effects of exemplary embodiments are described taking examples in which different color inks are supplied to multiple recording heads. However, it is to be noted that the configuration of the recording heads and ink is not limited to the above-described configuration but, for example, a single color ink may be supplied to multiple recording heads or inks of different compositions may be supplied to multiple recording heads. Alternatively, a configuration in which different types of liquids are ejected from a single head having multiple nozzle rows may be employed in a liquid supply system. The image forming apparatus is not limited to an image forming apparatus that ejects "ink" in strict meaning but may be a liquid ejection apparatus (included in the image forming apparatus in this disclosure) that ejects liquid other than strictly-defined "ink".

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head having nozzles to eject droplets of liquid;

a head tank having a plurality of liquid chambers to supply the liquid to the recording head, the plurality of liquid chambers having a plurality of exhaust ports, respectively, to exhaust air therefrom;

an exhaust unit connected to the head tank to exhaust air from the head tank; and a suctioning device connected to the exhaust unit, wherein the exhaust unit includes an exhaust channel connected to the suctioning device to exhaust air from the head tank, a single exhaust chamber connected to the plurality of exhaust ports of the plurality of liquid chambers, the plurality of exhaust ports being commonly opened to the single exhaust chamber, a single valve member commonly provided for the plurality of exhaust ports to open and close the plurality of exhaust ports collectively, a valve driving chamber communicating with the exhaust channel and having a flexible member at least partially forming a wall face of the valve driving chamber;

a valve driving member disposed at the flexible member to open and close the single valve member, and a single choke channel communicating the single exhaust chamber with the valve driving chamber, and wherein when the single valve member is opened, the plurality of exhaust ports is collectively opened and air of the plurality of liquid chambers is discharged to the valve driving chamber via the single choke channel, and the air flows in an air exhaust path from a liquid chamber amongst the plurality of liquid chambers through, in recited order, a corresponding exhaust port amongst the plurality of exhaust ports, the single valve member the single exhaust chamber, the single choke channel the valve driving chamber, and the exhaust channel, and is exhausted through the exhaust channel by the suctioning device, wherein the single choke channel is disposed in the air exhaust path between the single valve member and the suctioning device, and when the suctioning device suctions air through the exhaust channel with the liquid being in the single choke channel, a volume of the valve driving chamber contracts and the single valve member opens the plurality of exhaust ports.

2. The image forming apparatus of claim 1, wherein the single choke channel communicates a lower portion of the exhaust chamber with a lower portion of the valve driving chamber.

3. The image forming apparatus of claim 1, wherein the valve driving chamber has an urging member that urges the valve driving member in a direction to increase the volume of the valve driving chamber.

4. The image forming apparatus of claim 1, wherein the plurality of liquid chambers has an exhaust adjustment valve to increase fluid resistance of the exhaust ports with rise of liquid level in the plurality of liquid chambers.

5. The image forming apparatus of claim 1, wherein the plurality of liquid chambers has a liquid level detector to detect a position of liquid level in the plurality of liquid chambers.

6. The image forming apparatus of claim 1, further comprising a volume detector to detect the volume of the valve driving chamber.

7. The image forming apparatus of claim 6, wherein, when the volume detector detects that a contracted state of the valve driving chamber has continued over a threshold time, the suctioning device stops suctioning air through the exhaust channel.

8. The image forming apparatus of claim 7, wherein, when the volume detector detects an increase in the volume of the valve driving chamber after the suctioning device stops suctioning air through the exhaust channel, the image forming apparatus determines that exhaust of air from the head tank has been completed.

* * * * *